US010871121B2

(12) United States Patent
Kuempel et al.

(10) Patent No.: US 10,871,121 B2
(45) Date of Patent: Dec. 22, 2020

(54) METHOD FOR OPERATING AN ELECTRIC FUEL PUMP

(71) Applicant: Robert Bosch GmbH, Stuttgart (DE)

(72) Inventors: Joerg Kuempel, Ludwigsburg (DE); Klaus Joos, Walheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/079,286

(22) PCT Filed: Feb. 23, 2017

(86) PCT No.: PCT/EP2017/054142

§ 371 (c)(1),
(2) Date: Aug. 23, 2018

(87) PCT Pub. No.: WO2017/153176

PCT Pub. Date: Sep. 14, 2017

(65) Prior Publication Data

US 2019/0048821 A1 Feb. 14, 2019

(30) Foreign Application Priority Data

Mar. 7, 2016 (DE) ..... 10 2016 203 652

(51) Int. Cl.
*F02D 41/30* (2006.01)
*F02D 41/06* (2006.01)
(Continued)

(52) U.S. Cl.
CPC ..... *F02D 41/3082* (2013.01); *F02D 41/042* (2013.01); *F02D 41/064* (2013.01);
(Continued)

(58) Field of Classification Search
CPC ..... F02D 41/3082; F02D 41/3854; F02D 41/065; F02D 41/064; F02D 2200/70;
(Continued)

(56) References Cited

U.S. PATENT DOCUMENTS 5,542,395 A * 8/1996 Tuckey ..... F02D 41/3082 123/381
5,715,797 A * 2/1998 Minagawa ..... F02D 41/3082 123/497
(Continued)

FOREIGN PATENT DOCUMENTS

DE 10303411 B3 5/2004
DE 102005043684 A1 3/2007
(Continued)

OTHER PUBLICATIONS

International Search Report for PCT/EP2017/054142, dated May 9, 2017.

*Primary Examiner* — Sizo B Vilakazi
*Assistant Examiner* — Brian R Kirby
(74) *Attorney, Agent, or Firm* — Norton Rose Fulbright US LLP; Gerard Messina

(57) ABSTRACT

A method is described for operating an electric fuel pump constituting a low-pressure pump in a fuel supply system for an internal combustion engine, having a high-pressure reservoir and a high-pressure pump, of a motor vehicle. The electric fuel pump is operated at least temporarily, during a time period during which the internal combustion engine is switched off during operation of the motor vehicle, with a minimum value for a control application variable for the electric fuel pump.

13 Claims, 3 Drawing Sheets

(51) Int. Cl.
*F02D 41/38* (2006.01)
*F02D 41/04* (2006.01)

(52) U.S. Cl.
CPC ..... *F02D 41/065* (2013.01); *F02D 41/3854* (2013.01); *F02D 2200/0604* (2013.01); *F02D 2200/0608* (2013.01); *F02D 2200/0611* (2013.01); *F02D 2200/501* (2013.01); *F02D 2200/70* (2013.01)

(58) Field of Classification Search
CPC ..... F02D 2200/501; F02D 2200/0611; F02D 2200/0608; F02D 2200/0604; F02D 41/042
USPC ..... 123/497
See application file for complete search history.

(56) References Cited

U.S. PATENT DOCUMENTS 5,762,046 A * 6/1998 Holmes ..... F02D 41/3082 123/497
6,708,671 B1 * 3/2004 Joos ..... F02D 41/1401 123/464
6,889,656 B1 * 5/2005 Rembold ..... F02D 41/062 123/446
7,363,916 B2 * 4/2008 Eser ..... F02D 41/3082 123/497
7,966,984 B2 * 6/2011 Ulrey ..... F02M 37/20 123/179.17
8,061,329 B2 * 11/2011 Pursifull ..... F02M 37/0058 123/446
8,538,663 B2 * 9/2013 Jung ..... F02D 41/3854 701/103
9,284,907 B2 * 3/2016 Yamaguchi ..... F02D 41/3082
9,732,694 B2 * 8/2017 Mori ..... F02D 41/3082
10,094,319 B2 * 10/2018 Ulrey ..... F02D 41/3082
10,296,016 B1 * 5/2019 Payne ..... F04D 15/0066
10,317,894 B2 * 6/2019 Cheng ..... G05B 19/46
2002/0020397 A1 * 2/2002 Begley ..... F02M 69/462 123/497
2002/0124834 A1 * 9/2002 Rembold ..... F02D 41/061 123/514
2005/0123408 A1 * 6/2005 Koehl ..... F04B 49/06 417/53
2005/0199219 A1 * 9/2005 Utsumi ..... F02D 41/22 123/458
2008/0067116 A1 * 3/2008 Anderson ..... F04D 15/0066 210/100
2008/0276909 A1 * 11/2008 Rumpf ..... F02M 37/106 123/497
2009/0107461 A1 4/2009 Ulrey et al.
2009/0114191 A1 5/2009 Pursifull et al.
2010/0115959 A1 * 5/2010 Anson ..... F02C 7/22 60/772
2010/0163004 A1 * 7/2010 Kurata ..... F02D 41/406 123/491
2010/0274467 A1 * 10/2010 Hayami ..... F02D 41/2438 701/103
2010/0332108 A1 * 12/2010 Kato ..... F02M 37/025 701/104
2013/0025268 A1 * 1/2013 Bauer ..... F01N 3/208 60/317
2013/0166482 A1 * 6/2013 Veit ..... F02D 41/2464 706/12
2014/0227107 A1 * 8/2014 Bauer ..... F04B 17/044 417/44.2
2014/0230791 A1 * 8/2014 Kojima ..... F02D 41/123 123/446
2015/0240771 A1 * 8/2015 Pursifull ..... F02M 65/002 73/114.41
2015/0275812 A1 * 10/2015 Mori ..... F02D 33/003 123/497
2016/0146146 A1 * 5/2016 Pursifull ..... F02D 41/3854 701/104
2016/0319773 A1 * 11/2016 Matsumoto ..... F02D 41/3082
2017/0284330 A1 * 10/2017 Behrendt ..... F02D 41/123
2017/0335841 A1 * 11/2017 Burazer ..... F04B 51/00

FOREIGN PATENT DOCUMENTS

DE 102007058229 A1 6/2009
DE 102010043280 A1 5/2012
DE 102011002523 A1 7/2012
EP 1415077 A1 5/2004
EP 2762718 A1 8/2014
EP 2884076 A2 6/2015
EP 2940278 A1 11/2015
JP 08061175 A * 3/1996

* cited by examiner

METHOD FOR OPERATING AN ELECTRIC FUEL PUMP

FIELD OF THE INVENTION

The present invention relates to a method for operating an electric fuel pump and to a computation unit and a computer program for carrying it out.

BACKGROUND INFORMATION

In modern motor vehicles having internal combustion engines, one or more electric fuel pumps, in particular in the form of so-called "pre-supply" pumps, by way of which fuel is conveyed out of a fuel tank to a high-pressure pump, are used in the low-pressure fuel system, i.e. in the low-pressure region of the fuel supply system.

The advantages of rapid availability thanks to pre-delivery of fuel by an electric fuel pump are thereby combined with the advantages of the hydraulic efficiency of a high-pressure pump driven by the internal combustion engine. Fuel delivery can furthermore be effected in accordance with demand. An electric fuel pump (EFP) as a rule requires a separate control system or regulation system, and has for that purpose an electronic system that, for example, can be integrated into the fuel pump.

SUMMARY

According to the present invention, a method for operating an electric fuel pump, as well as a computation unit and a computer program for carrying it out are proposed.

A method according to the present invention serves to operate an electric fuel pump constituting a low-pressure pump in a fuel supply system for an internal combustion engine, having a high-pressure reservoir and a high-pressure pump, of a motor vehicle. The electric fuel pump can usefully be disposed in an in-tank unit that in turn is disposed in the fuel tank. In addition to the electric fuel pump, the in-tank unit can also have a pre-supply cup, a pressure limiting valve, a check valve, and also one or more suction jet pumps that allow the pre-supply cup, from which the electric fuel pump can then draw in the fuel, to be filled.

The electric fuel pump is operated at least temporarily, during a time period during which the internal combustion engine is switched off during operation of the motor vehicle, with a minimum value for the control application variable for the electric fuel pump. In the context of a refinement of the method, the minimum value for the control application variable is preferably ascertained previously. The control application variable can be in particular a control application current, or also a voltage or a pulse duty factor for such a voltage by way of which the control application current can be adjusted. A motor vehicle in which the internal combustion engine is shut off during operation of the motor vehicle itself can be, for example, a motor vehicle having a "start-stop" system that shuts off the internal combustion engine during waiting times, for example at traffic signals, in order to reduce fuel consumption and pollutant emissions. Alternatively or additionally it can be a hybrid vehicle, which has an electric machine in addition to the internal combustion engine and in which, for example, the internal combustion engine can be shut off for exclusively electric propulsion of the motor vehicle.

The internal combustion engine needs to be restarted quickly when necessary, however. In conventional motor vehicles the low-pressure supply system as a rule is switched off for acoustic reasons during the internal combustion engine's stop phase; this has little relevance, since a pre-pressure built up by the electric fuel pump does not decrease due to a check valve that is used as a rule in the in-tank unit. If temperatures in the fuel tank are high upon a restart, however, a problem can occur with a pressure buildup in the low-pressure system, namely when the temperature in the fuel tank is in the vicinity of the vapor pressure of the fuel being used. There can be greater formation of vapor in the fuel tank, in particular at the hottest points, especially at the electric fuel pump which is heated by current flow. As a result of vapor formation at and in the electric fuel pump, the latter can become emptied during the stop phase, i.e. fuel in the electric fuel pump is forced back by the vapor into the fuel tank or into the pre-supply cup of the in-tank unit, so that upon restarting of the electric fuel pump, delivery and pressure buildup by the electric fuel pump are greatly delayed.

Vapor in the electric fuel pump can greatly reduce the latter's efficiency and can prevent reliable delivery of fuel. Only when a pump impeller of the electric fuel pump is once again surrounded by liquid fuel can it provide its full pumping effect. For this, however, firstly the vapor must be displaced out of the electric fuel pump. In extreme cases this can take several seconds. With the delayed pressure buildup of the electric fuel pump, startup of the internal combustion engine combustion is thus delayed. This is disadvantageous in particular when a quick departure is desired or stipulated by the driver. The consequence can be power loss, faltering, or stalling of the internal combustion engine. The high-pressure reservoir and the quantity of compression contained therein can meet the fuel demand of the internal combustion engine for a certain time, but the high pressure then collapses to insufficient values, and the injection quantities for the fuel injectors can no longer be outputted as desired. As a design measure, a venting valve to assist the removal of vapor from the electric fuel pump can also, for example, inter alia be used on the in-tank unit, but this results in additional cost. This furthermore does not ensure complete avoidance of delayed pressure buildup.

The invention takes effect here, by the fact that the electric fuel pump is operated even during such a stop phase. This prevents the electric fuel pump from being emptied during the stop phase due to excessive vapor pressure in the fuel tank. Aside from this, operation of the electric fuel pump also largely prevents the formation of vapor in the first place. This prevents any delay in restarting the internal combustion engine, and the further problems associated therewith. In addition, however, noise emissions during the stop phase are minimized by the fact that the electric fuel pump is operated with a minimum value for the relevant control application variable, i.e. a minimum possible value. Reference may be made to the statements below regarding appropriate values for the minimum value. The overall result of the proposed method is therefore to make possible rapid restarting of the internal combustion engine after a low-noise stop phase, without using additional components.

Advantageously, the electric fuel pump is operated for the time period at the minimum value only upon exceedance of a threshold value for a pressure and/or a temperature in a fuel tank in which the electric fuel pump is disposed, and is otherwise switched off. As already mentioned, emptying of the electric fuel pump during the stop phase is caused by the vapor pressure in the fuel tank. Since such emptying occurs, however, only above a certain pressure in the fuel tank which in turn, at least also, depends on the temperature in the fuel tank, it is useful to operate the electric fuel pump even during the stop phase only when pressures or temperatures are sufficiently high. Unnecessary operation at low pressures or temperatures can thus be avoided, thereby e.g. saving energy.

Advantageously, the pressure and/or the temperature are ascertained by way of a model and by way of at least one of the following variables: temperature outside the motor vehicle, speed of the motor vehicle, fill level of the fuel tank, control application current to the electric fuel pump, delivery volume of the electric fuel pump, exhaust gas mass flow, temperature of the exhaust gas, detection of fueling operation, duration of the most recent complete shutoff of the motor vehicle, pressure outside the motor vehicle, and composition of the fuel in the fuel tank. The aforesaid variables can be utilized in order to ascertain the pressure or the temperature in the fuel tank. While one of the aforesaid variables may already be sufficient for ascertaining the pressure or temperature, more accurate values can be ascertained by using several of the variables (if available). The variables can usefully be used as input variables for the model. The overall result thereof is that it is possible, for example, to estimate a critical temperature range in the fuel tank above which vapor formation occurs, and above which the electric fuel pump should be operated even during the stop phases.

Operation of the electric fuel pump at the minimum value is furthermore preferably continued only for the time period during which at least one triggering condition is met. It is thereby possible to take into consideration, for example, the fact that a restart does not occur after every shutoff of the internal combustion engine, or it occurs, for example, only after a longer time period, so that further operation of the electric fuel pump, for example, would consume too much energy. A triggering condition is preferably met when the shutoff of the internal combustion engine occurs as a result of an electrical propulsion phase in the context of hybrid operation, or as a result of a stoppage in the context of start/stop operation. Especially in start/stop systems with speed-dependent shutoff of the internal combustion engine as early as the coasting phase, for example approaching a traffic signal or stop sign, the triggering condition can already be met during coasting.

It is advantageous if, in order to ascertain the minimum value for the control application variable, a value for the control application variable at which zero delivery by the electric pump occurs is ascertained. At zero delivery, the electric fuel pump builds up just enough pressure that fuel is drawn in but is not conveyed further toward the high-pressure pump. This may already be sufficient to prevent emptying of the electric fuel pump, so that the value of the control application variable which corresponds to zero delivery can be used as a minimum value. It may also be the case, however, that, a sufficient flow through suction jet pumps that may be present is not achieved even at zero delivery. In such a case the value of the control application variable which corresponds to zero delivery can additionally have a suitable offset or supplement added to it, and can then be used as a minimum value. Such an offset can be derived for that purpose, for example, from a characteristic curve of the suction jet pumps. The minimum value can then, for example, be stored in an executing control device and used as necessary in order to operate the electric fuel pump.

The minimum value is preferably ascertained during a pre-running mode of the electric fuel pump prior to starting, in particular cold starting, of the internal combustion engine. In particular, the value of the control application variable at which zero delivery occurs can also be ascertained during so-called pre-running of the electric fuel pump. For this EKP pre-running mode, the electric fuel pump is usually operated as soon as the driver door opens or, at the latest, when the ignition key is turned (usually so-called "terminal 15"), so that the pressure required in the low-pressure system for operation of the high-pressure pump can be built up, and so that pressure is reliably available upon subsequent starting of the internal combustion engine.

Usefully, the value for the control application variable at which zero delivery occurs is ascertained by the fact that the control application variable is elevated continuously or stepwise until a pressure rise in the high-pressure reservoir and/or in a low-pressure region of the fuel supply system is detectable. For this purpose, for example, as mentioned, the electric fuel pump can be operated in a pre-running mode (called EKP pre-running) before starting, in particular cold starting, of the internal combustion engine. A minimum possible value of the control application variable can then be set so that no pressure is yet being built up by the electric fuel pump. The pressure in the high-pressure reservoir can then be ascertained and the control application variable can be elevated, for example in the form of a ramp, until a pressure buildup in the high-pressure reservoir is detected. It is important to consider that as a rule, a pressure buildup can take place only if the high-pressure reservoir has previously been dissipated, for example after an extended shutdown of the internal combustion engine and of the high-pressure pump. Immediately before a pressure buildup occurs—which can be ascertained, for example, by way of a pressure sensor that is present as a rule on the high-pressure reservoir—zero delivery by the electric fuel pump has been reached. If a pressure sensor is also present in the low-pressure region, zero delivery can also be ascertained by way of such a sensor.

A computation unit according to the present invention, for instance a control device of a motor vehicle, is configured to carry out, for example by programmed execution, a method according to the present invention.

Implementation of the method in the form of a computer program is also advantageous, since this entails particularly low costs especially if an executing control device is also used for further tasks and is therefore present in any case. Suitable data media for furnishing the computer program are, in particular, magnetic, optical, and electrical memories, for instance hard drives, flash memories, EEPROMs, DVDs, and many others. Downloading of a program via computer networks (internet, intranet, etc.) is also possible.

Further advantages and embodiments of the invention are evident from the description and the appended drawings.

The invention is schematically depicted in the drawings on the basis of an exemplifying embodiment and will be described below with reference to the drawings.

DETAILED DESCRIPTION

Figure 1:
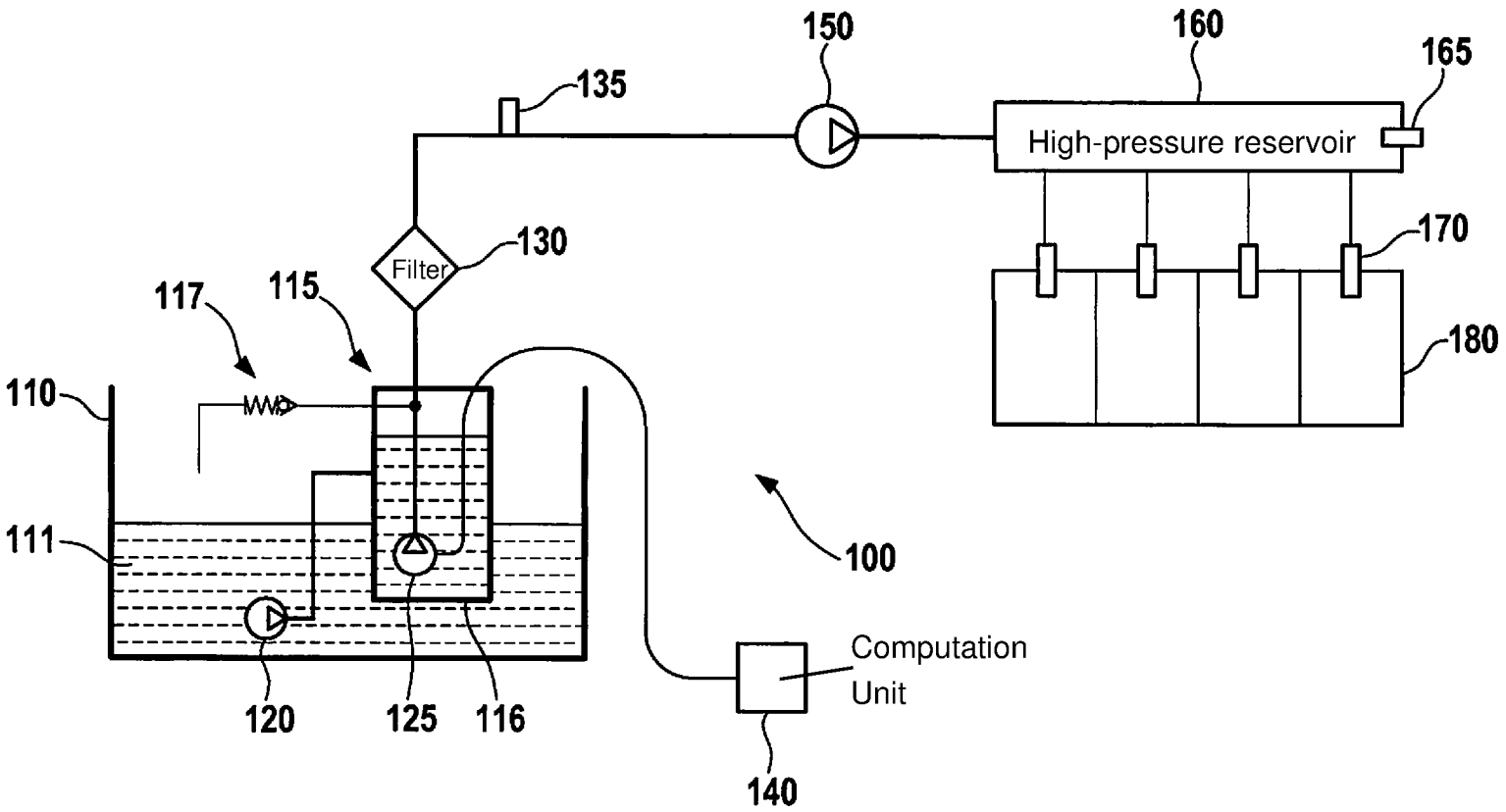
FIG. 1 schematically depicts a fuel supply system for an internal combustion engine which can be used for a method according to the present invention.

FIG. 1 schematically depicts a fuel supply system 100 for an internal combustion engine 180, which can be used for a method according to the present invention.

Fuel supply system 100 encompasses a fuel tank 110 that is filled with fuel 111. Located in fuel tank 110 is an in-tank unit 115 that in turn has a pre-supply cup 116 in which an electric fuel pump 125, operating as a low-pressure pump, is disposed.

Pre-supply cup 115 can be filled with fuel from fuel tank 110 via a suction jet pump 120 (or, if applicable, also several suction jet pumps) disposed in fuel tank 110 outside the pre-supply cup. Electric fuel pump 125 can have control applied to it via a computation unit 140 embodied here as a pump control device, so that fuel is delivered out of pre-supply cup 115 via a filter 130 to a high-pressure pump 150. A pressure limiting valve 117 is provided in the low-pressure line.

A pressure sensor 135 for detecting the pressure in the low-pressure line is provided here by way of example in the low-pressure line, i.e. before high-pressure pump 150. As already explained, however, a pressure sensor of this kind in the low-pressure region is not necessary for execution of the proposed method.

High-pressure pump 150 as a rule is driven via internal combustion engine 180 or its camshaft. Fuel is then conveyed from high-pressure pump 150 into a high-pressure reservoir 160, from which fuel can be delivered via fuel injectors 170 to internal combustion engine 180. A pressure sensor 165, with which a pressure in the high-pressure reservoir can be detected, is furthermore provided on high-pressure reservoir 160.

Control can be applied to internal combustion engine 180 or to fuel injectors 170 via an engine control device different from pump control device 140, in which context the control devices can then communicate with one another. It is also conceivable, however, to use one shared control device.

Figure 2:
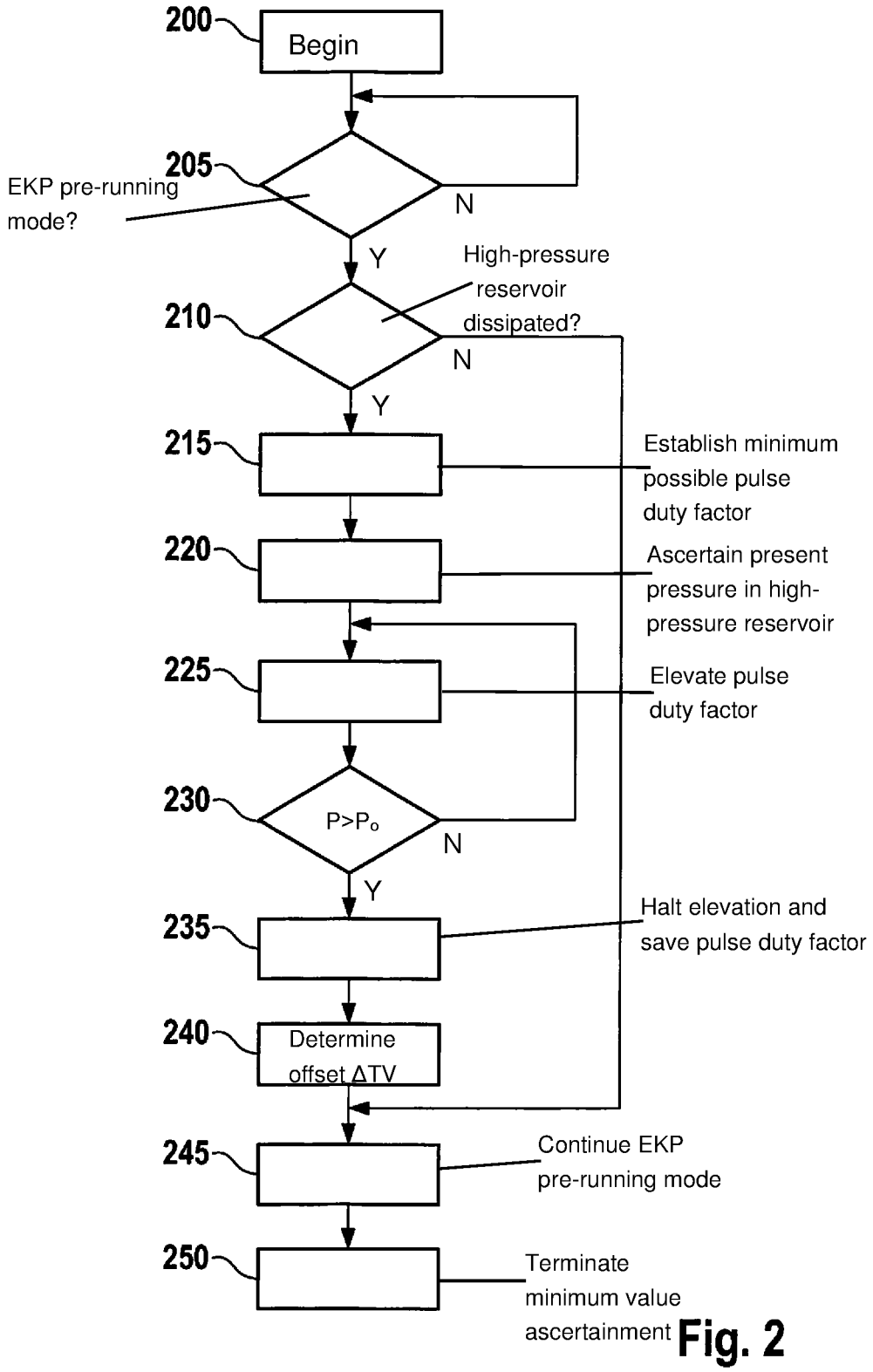
FIG. 2 schematically shows an execution sequence for ascertaining a minimum value for a control application variable in the context of a method according to the present invention in a preferred embodiment.

FIG. 2 schematically depicts an execution sequence for ascertaining a minimum value for a control application variable in the context of a method according to the present invention in a preferred embodiment.

Figure 3:
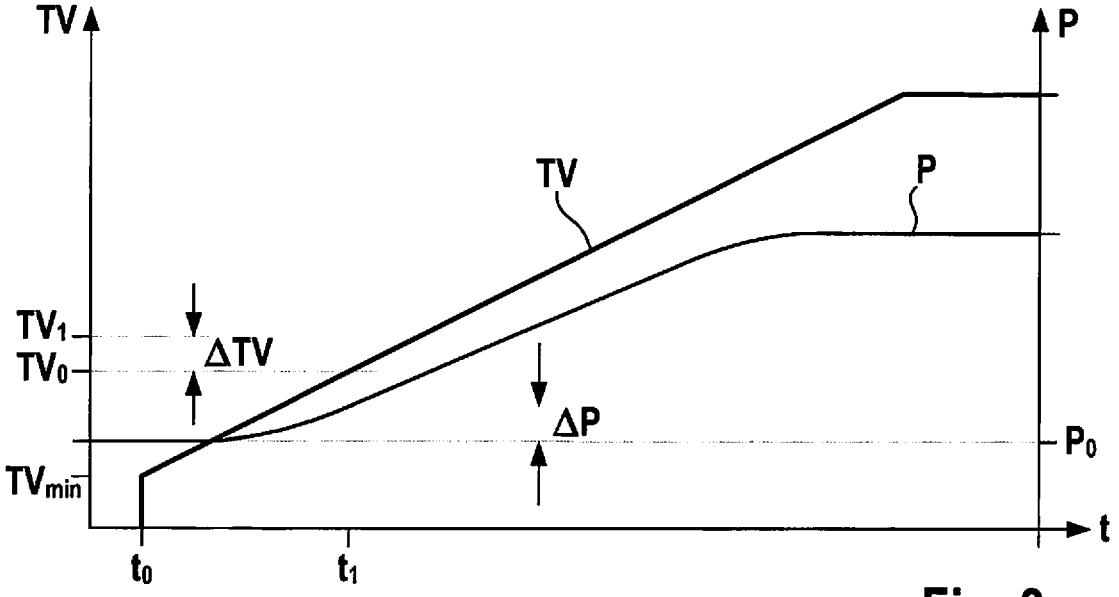
FIG. 3 schematically shows profiles of the pressure in the high-pressure reservoir and of the control application variable upon execution of a method according to the present invention in a preferred embodiment.

FIG. 3 schematically shows profiles, respectively as a function of time t, for the pressure P in the high-pressure reservoir and for the control application variable, here a pulse duty factor TV, upon execution of a method according to the present invention in a preferred embodiment. The execution sequence for ascertaining a minimum value as shown in FIG. 2 will be explained in further detail below with reference to FIG. 3.

Ascertainment of the minimum value can firstly begin in a step 200. In a step 205 a check can then be made as to whether the electric fuel pump is in the EKP pre-running mode, and whether it is possible to begin ascertainment, which in particular encompasses a pressure buildup in the high-pressure reservoir. Usually the electric fuel pump is operated as soon as the driver's door is opened or the ignition key is turned (terminal 15), in order to build up the necessary pressure in the low-pressure system. This phase of EKP pre-running can be used to determine the minimum value of the control application for zero delivery. If not, for example because the electric fuel pump is not in the EKP pre-running mode, execution branches back to step 200.

If the electric fuel pump is in EKP pre-running mode, a check can be made in a step 210 as to whether the elapsed time during which the internal combustion engine was shut off was sufficiently long that the pressure in the high-pressure reservoir has dissipated. If this is not the case, execution can branch immediately to step 245, and the electric fuel pump can be operated normally without ascertaining the minimum value.

If the pressure in the high-pressure reservoir has dissipated, in a step 215 a minimum possible pulse duty factor $TV_{min}$, as shown in FIG. 3, can be established. The minimum possible pulse duty factor $TV_{min}$ can be a pulse duty factor or voltage at which a control application current at which the electric fuel pump can still just be operated is generated.

If applicable, the present pressure $P_0$ in the high-pressure reservoir, as also depicted in FIG. 3, can furthermore also be ascertained in a step 220 simultaneously with or shortly before step 215.

In a step 225, while control is applied to the electric fuel pump, the pulse duty factor TV can then be elevated, for example in ramped fashion, i.e. linearly and quasi-continuously, or stepwise, as shown in FIG. 3 starting at time $t_0$.

As soon as a pressure rise is then detected in the high-pressure reservoir, i.e., for example, as soon as the pressure P in the high-pressure reservoir is higher than the pressure $P_0$ by an amount equal to a threshold $\Delta P$, the elevation of the pulse duty factor can be halted in accordance with a step 230, as is the case at time $t_1$ in FIG. 3. Conversely, in accordance with step 225 the pulse duty factor can continue to be elevated as long as no pressure rise is detected.

The result here is to ascertain a pulse duty factor $TV_0$ at which zero delivery occurs. That pulse duty factor $TV_0$ can then, for example in a step 235, be saved in the associated pump control device.

But because, as already mentioned, the suction jet pump may not yet be delivering sufficiently at the pulse duty factor $TV_0$, an offset $\Delta TV$ can then be ascertained in a step 240 and added, thus yielding the minimum value $TV_1$. The minimum value $TV_1$ can also be saved in the pump control device.

The regular EKP pre-running mode of the electric fuel pump can then, in a step 245, be continued in order to convey fuel to the high-pressure pump, so that ascertainment of the minimum value is terminated in a step 250.

Figure 4:
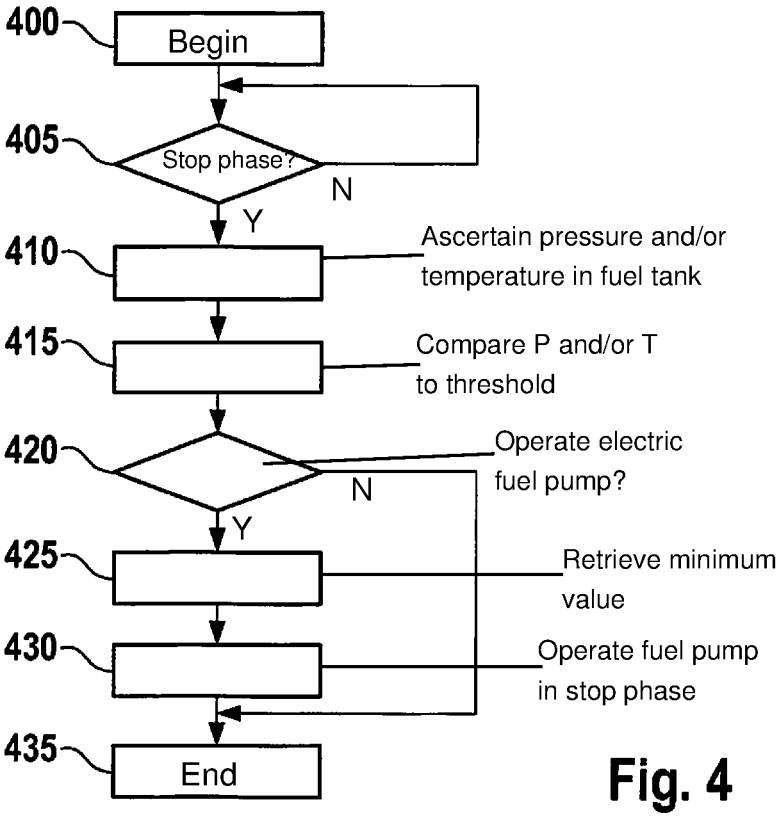
FIG. 4 schematically shows an execution sequence for operating the electric fuel pump with the minimum value in the context of a method according to the present invention in a preferred embodiment.

FIG. 4 schematically shows an execution sequence for operating the electric fuel pump with the minimum value in the context of a method according to the present invention in a preferred embodiment.

The method can firstly begin in a step 400. A check can then be made in a step 405 as to whether a stop phase of the internal combustion engine exists, i.e. whether the internal combustion engine is shut off. A check can also be made in this context as to the reason why the internal combustion engine is shut off, i.e. whether the stop phase exists, for example, due to an electrical propulsion phase in the context of hybrid operation or due to a stoppage in the context of a start/stop mode.

If the stop phase is not occurring for a reason such that the electric fuel pump is to be operated during the stop phase, execution can then branch back to step 400.

Otherwise, in a step 410 a pressure and/or a temperature in the fuel tank can be ascertained by way of a model and using suitable variables that have been mentioned previously.

In a step 415 it is then possible to ascertain whether the pressure and/or the temperature are above a threshold value such that without operation of the electric fuel pump, the electric fuel pump would be emptied because of the vapor pressure in the fuel tank.

In a step 420 it is then possible to decide whether the electric fuel pump is to be operated. If not, the method can be terminated by branching directly to step 435 (termination).

Otherwise, in a step 425 the minimum value—which, as explained above, has been saved e.g. in the pump control device—is retrieved. According to a step 430 the electric fuel pump can then be operated during the stop phase, if applicable only temporarily, using the minimum value for the pulse duty factor; the method is then terminated in accordance with step 435, i.e. when the stop phase has ended and the internal combustion engine is restarted.

What is claimed is:

1. A method for operating an electric fuel pump constituting a low-pressure pump in a fuel supply system for an internal combustion engine of a motor vehicle, the fuel supply system including a high-pressure reservoir and a high-pressure pump, the method comprising:

ascertaining a minimum value for a control application variable for the electric fuel pump, the minimum value being a value for the control application variable at which the electric fuel pump draws in fuel but does not convey any fuel toward the high-pressure pump; and operating the electric fuel pump at least temporarily, during a time period during which the internal combustion engine is switched off during operation of the motor vehicle, with the ascertained minimum value for the control application variable for the electric fuel pump;

wherein the method further comprises determining a value for the control application variable at which zero delivery by the electric pump occurs, wherein the minimum value for the control application variable is ascertained in the ascertaining step using the value for the control application variable at which the zero delivery by the electric pump occurs;

wherein the fuel supply system further includes at least one suction jet pump, and wherein the minimum value for the control application variable is also ascertained based on a characteristic curve of the at least one suction jet pump.

2. The method as recited in claim 1, wherein the electric fuel pump is operated for the time period at the minimum value only upon exceedance of a threshold value for at least one of a pressure and a temperature in a fuel tank in which the electric fuel pump is disposed.

3. The method as recited in claim 2, further comprising:

ascertaining the at least one of the pressure and the temperature by way of a model and by way of at least one of the following variables:

a temperature outside the motor vehicle, a speed of the motor vehicle, a fill level of the fuel tank, a control application current to the electric fuel pump, a delivery volume of the electric fuel pump, an exhaust gas mass flow, a temperature of the exhaust gas, a detection of a fueling operation, a duration of a most recent complete shutoff of the motor vehicle, a pressure outside the motor vehicle, and a composition of a fuel in the fuel tank.

4. The method as recited in claim 1, wherein the electric fuel pump is operated at the minimum value for the time period only when at least one triggering condition is met.

5. The method as recited in claim 1, wherein the value for the control application variable at which zero delivery occurs is determined by elevating the control application variable one of continuously, quasi-continuously, and stepwise until a pressure rise in at least one of the high-pressure reservoir and a low-pressure region of the fuel supply system is detectable.

6. The method as recited in claim 1, wherein the minimum value for the control application variable is ascertained during a pre-running mode of the electric fuel pump before starting of the internal combustion engine.

7. The method as recited in claim 1, wherein the minimum value for the control application variable is ascertained during a pre-running mode of the electric fuel pump before a cold starting of the internal combustion engine.

8. The method as recited in claim 1, wherein the electric fuel pump is an electric fuel pump that is disposed in an in-tank unit that in turn is disposed in the fuel tank.

9. The method as recited in claim 1, wherein the electric fuel pump conveys fuel to the high-pressure pump while the internal combustion engine operates.

10. A computation unit configured to operate an electric fuel pump constituting a low-pressure pump in a fuel supply system for an internal combustion engine of a motor vehicle, the fuel supply system including a high-pressure reservoir and a high-pressure pump, the computation unit configured to:

ascertain a minimum value for a control application variable for the electric fuel pump, the minimum value being a value for the control application variable at which the electric fuel pump draws in fuel but does not convey any fuel toward the high-pressure pump; and operate the electric fuel pump at least temporarily, during a time period during which the internal combustion engine is switched off during operation of the motor vehicle, with the ascertained minimum value for the control application variable for the electric fuel pump;

wherein the computation unit is further configured to:

determine a value for the control application variable at which zero delivery by the electric pump occurs, wherein the minimum value for the control application variable is ascertained in the ascertaining step using the value for the control application variable at which the zero delivery by the electric pump occurs;

wherein the fuel supply system further includes at least one suction jet pump, and wherein the minimum value for the control application variable is also ascertained based on a characteristic curve of the at least one suction jet pump.

11. The computation unit as recited in claim 10, wherein computation unit determines the value for the control application variable at which zero delivery by elevating the control application variable one of continuously, quasi-continuously, and stepwise until a pressure rise in at least one of the high-pressure reservoir and a low-pressure region of the fuel supply system is detectable.

12. A non-transitory machine-readable memory medium that stores a computer program for operating an electric fuel pump constituting a low-pressure pump in a fuel supply system for an internal combustion engine of a motor vehicle, the fuel supply system including a high-pressure reservoir and a high-pressure pump, the computer program, when executed by a computation unit, causing the computation unit to perform the following steps:

ascertaining a minimum value for a control application variable for the electric fuel pump, the minimum value being a value for the control application variable at which the electric fuel pump draws in fuel but does not convey any fuel toward the high-pressure pump; and operating the electric fuel pump at least temporarily, during a time period during which the internal combustion engine is switched off during operation of the motor vehicle, with the ascertained minimum value for the control application variable for the electric fuel pump;

wherein the computer program, when executed by the computation unit, causes the computation unit to perform the following addition step:

determining a value for the control application variable at which zero delivery by the electric pump occurs, wherein the minimum value for the control application variable is ascertained in the ascertaining step using the value for the control application variable at which the zero delivery by the electric pump occurs;

wherein the fuel supply system further includes at least one suction jet pump, and wherein the minimum value for the control application variable is also ascertained based on a characteristic curve of the at least one suction jet pump.

13. The non-transitory machine-readable memory medium as recited in claim 12, wherein the value for the control application variable at which zero delivery occurs is determined by elevating the control application variable one of continuously, quasi-continuously, and stepwise until a pressure rise in at least one of the high-pressure reservoir and a low-pressure region of the fuel supply system is detectable.

* * * * *